US005449033A

United States Patent [19]

Van Ackeren

[11] Patent Number: 5,449,033

[45] Date of Patent: Sep. 12, 1995

[54] CYLINDER HEAD PATTERN ASSEMBLY

[75] Inventor: Timothy J. Van Ackeren, Milwaukee, Wis.

[73] Assignee: Outboard Marine Corporation, Waukegan, Ill.

[21] Appl. No.: 235,682

[22] Filed: Apr. 29, 1994

[51] Int. Cl.[6] ..... B22D 7/02

[52] U.S. Cl. ..... 164/249; 164/45

[58] Field of Search ..... 164/235, 246, 249, 45, 164/34, 35, 36

[56] References Cited

U.S. PATENT DOCUMENTS

| | | | |
|---|---|---|---|
| 4,777,997 | 10/1988 | Corbett | 164/246 |
| 4,802,447 | 2/1989 | Corbett | 123/65 |
| 4,883,110 | 11/1989 | Morgan et al. | 164/249 |
| 4,907,638 | 3/1990 | Hubbell et al. | 164/45 |
| 4,951,733 | 8/1990 | Kusche et al. | 164/246 |

FOREIGN PATENT DOCUMENTS 0282744 12/1987 Japan .

*Primary Examiner*—Kuang Y. Lin

*Attorney, Agent, or Firm*—Michael, Best & Friedrich

[57] ABSTRACT

Disclosed herein is a multi-piece cylinder head lost foam pattern assembly comprising a first piece having a planar valve seat surface extending at an angle other than 90° degrees to the axis of the associated cylinder, a glue surface extending in spaced and parallel relation to the valve seat surface on the opposite side thereof from the associated cylinder, and a first fluid flow passage portion extending between the valve seat surface and the glue surface, and a second piece having a first glue surface engaging the glue surface of the first piece, a second glue surface extending in spaced and parallel relation to the first glue surface of the second piece, a second fluid flow passage portion extending between the first and second glue surfaces of the second piece, and registering with the first fluid flow passage portion in the first piece, and a recess formed in the second glue surface and communicating with the second fluid flow passage portion, and a third piece having a first glue surface engaging the second glue surface of the second piece and including therein a recess mating with the recess in the second glue surface of the second piece and forming, with the recess in the second piece, a third fluid flow passage portion communicating with the second fluid flow passage portion.

6 Claims, 2 Drawing Sheets

CYLINDER HEAD PATTERN ASSEMBLY

BACKGROUND OF THE INVENTION

The invention relates generally to lost foam casting and, more particularly, to multi-piece lost foam pattern assemblies for use in the lost foam casting process. Still more particularly, the invention relates to multiple-piece lost foam pattern assemblies and to such pattern assemblies which are particularly adopted for casting a cylinder head for a four stroke internal combustion engine.

Attention is directed to the following United States Patents.

| Patent No. | Inventor(s) | Issue Date |
|---|---|---|
| 4,777,997 | William D. Corbett | October 18, 1988 |
| 4,802,447 | William D. Corbett | February 7, 1989 |
| 4,883,110 | Morgan, et al. | November 28, 1989 |
| 4,907,638 | Hubbell, et al. | March 13, 1990 |
| 4,951,733 | Kusche, et al. | August 28, 1990 |

Attention is also directed to Japanese Patent 0282744 granted Dec. 8, 1987.

In the past, multi-piece cylinder head pattern assemblies were constructed, as shown in FIG. 1, from four pieces 11, 12, 13, 14 which were adhesively glued along the three indicated glue lines 21, 22 and 23. It is noted that the glue line 21 extends, in part, at an angle to the other glue lines 22 and 23 and that as a result, the glue line 21 includes two portions 33 and 35 at an angle to one another. Furthermore, a flow piece passage 41 communicating with the exterior was formed, in part, in the pattern piece 12 and, in part, in the pattern piece 13. As a consequence, there was little flexibility in locating the connection of the passage portion 41 with the areas on the exterior casting surface where the passage portion 41 opened to the atmosphere and which were available for connection to fuel/air supply and exhaust manifolds. Specifically, in the construction shown in FIG. 1, any different location of the flow passages relative to the illustrated near optimum arrangement will result in reduced cross-sectional flow area and in an unsmooth passage configuration hindering fluid flow. This problem is particularly serious with respect to multi-cylinder engines.

SUMMARY OF THE INVENTION

The invention provides a multi-piece cylinder head lost foam pattern assembly comprising a first piece having a planar valve seat surface extending at an angle other than 90° degrees to the axis of an associated cylinder, a glue surface extending in spaced and parallel relation to said valve seat surface on the opposite side thereof from the associated cylinder, and a first fluid flow passage portion extending between the valve seat surface and the glue surface, a second piece having a first glue surface engaging the glue surface of the first piece, a second glue surface extending in spaced and parallel relation to the first glue surface of the second piece, a second fluid flow passage portion extending between the first and second glue surfaces of the second piece, and registering with the first fluid flow passage portion in the first piece, and a recess formed in the second glue surface and communicating with the second fluid flow passage portion, and a third piece having a first glue surface engaging the second glue surface of the second piece and including therein a recess mating with the recess in the second glue surface of the second piece and forming, with the recess in the second piece, a third fluid flow passage portion communicating with the second fluid flow passage portion.

The invention also provides a multi-piece cylinder head lost foam pattern assembly for casting of a cylinder head including first and second combustion chambers respectively associated with spaced and parallel first and second cylinders, said assembly comprising a first piece having first and second co-planar valve seat surfaces which are respectively associated with said first and second combustion chambers and which respectively extend at an angle other than 90° degrees to the axes of the associated cylinders, a glue surface extending in spaced and parallel relation to the valve seat surfaces on the opposite side thereof from the associated cylinders, and first and second fluid flow passage portions respectively extending generally perpendicularly to the valve seat surfaces between the valve seat surfaces and the glue surface, and a second piece having a first glue surface engaging the glue surface of the first piece, a second glue surface extending in spaced and parallel relation to the first glue surface of the second piece, third and fourth fluid flow passage portions extending between the first and second glue surfaces of the second piece and respectively registering with the first and second fluid flow passage portions in the first piece, and first and second recesses formed in the second glue surface and respectively communicating with the third and fourth fluid flow passage portions, and a third piece having a first glue surface engaging the second glue surface of the second piece and including therein third and fourth recesses respectively mating with the first and second recesses in the second glue surface of the second piece and respectively forming, with the first and second recesses in the second piece, fifth and sixth fluid flow passage portions respectively communicating with the third and fourth fluid flow passage portions.

Other features and advantages of the invention will become known by reference to the following general description and claims and the accompanying drawings.

Figure 1:
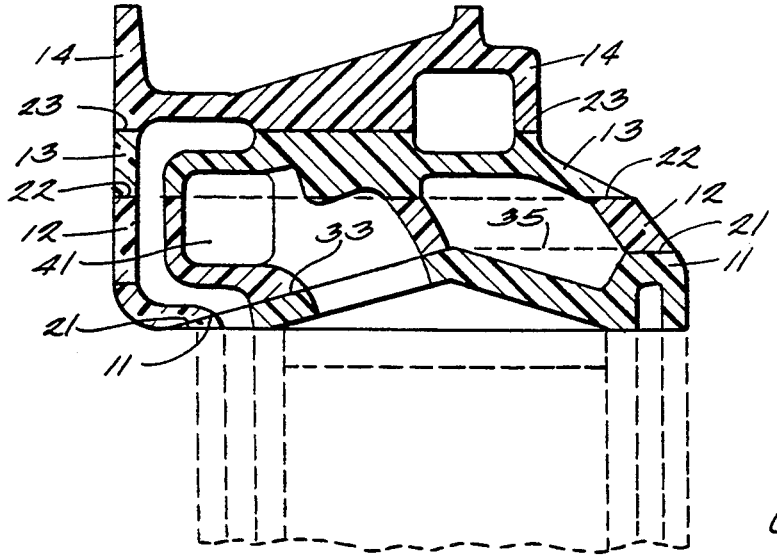
Fig. 1 PRIOR ART
FIG. 1 is a sectional view of a prior art multi-piece cylinder head lost foam pattern assembly.

Before one embodiment of the invention is explained in detail, it is to be understood that the invention is not limited in its arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 2:
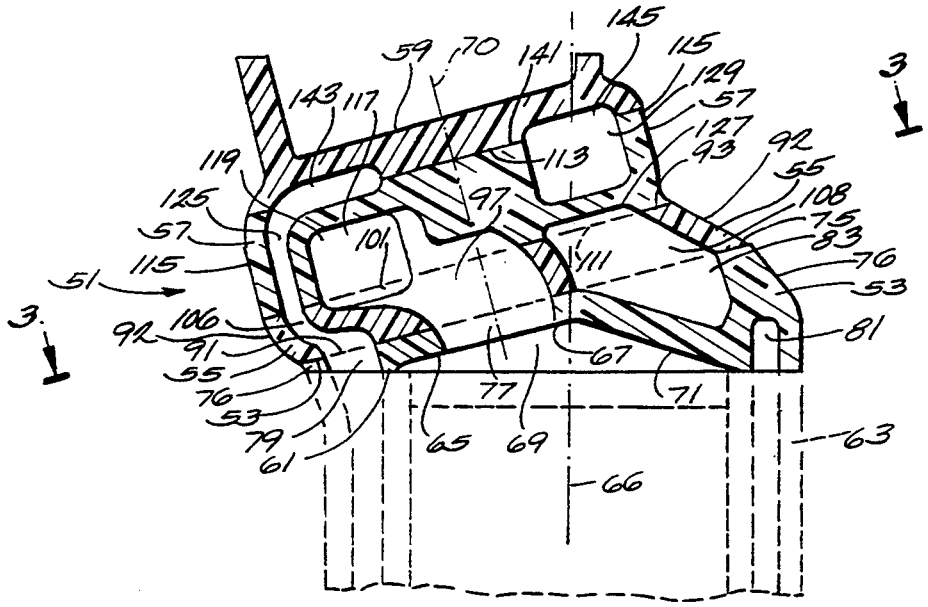
FIG. 2 is a sectional view of a multi-piece cylinder head lost foam pattern assembly which embodies various of the features of the invention.

Shown in FIG. 2 of the drawings is a multi-piece lost foam pattern assembly 51 which, when employed in the lost foam casting process, produces a cylinder head casting (not specifically shown) which is physically of the same shape and size as the pattern assembly 51 and which, after suitable machining, can be suitably secured to the head end of a cylinder block (shown in dotted outline). Alternatively, an integral one-piece cylinder block and cylinder head casting can be produced using the invention discussed herein.

The multi-piece pattern assembly 51 shown in FIG. 2 includes four separately molded pattern pieces 53, 55, 57, and 59 fabricated of evaporative foam.

The first piece 53 includes a planar cylinder block mating surface 61 which is adapted to mate with the head end of a cylinder block 63 (shown in dotted outline). In addition, the first pattern piece 53 includes an inclined planar surface 65 (or a plurality of co-planar surfaces) which extends at an acute angle to the cylinder block mating surface 61, i.e., at an angle of other than 90° to the axis 66 of the associated cylinder, and which includes therein two annular valve seats or valve seat areas 67 (one shown) separately affording inflow and outflow to and from a combustion chamber 69 and relative to which suitable valve members (not shown) are movable about or along respective axes 70 perpendicular to the planar surface 65.

Figure 3:
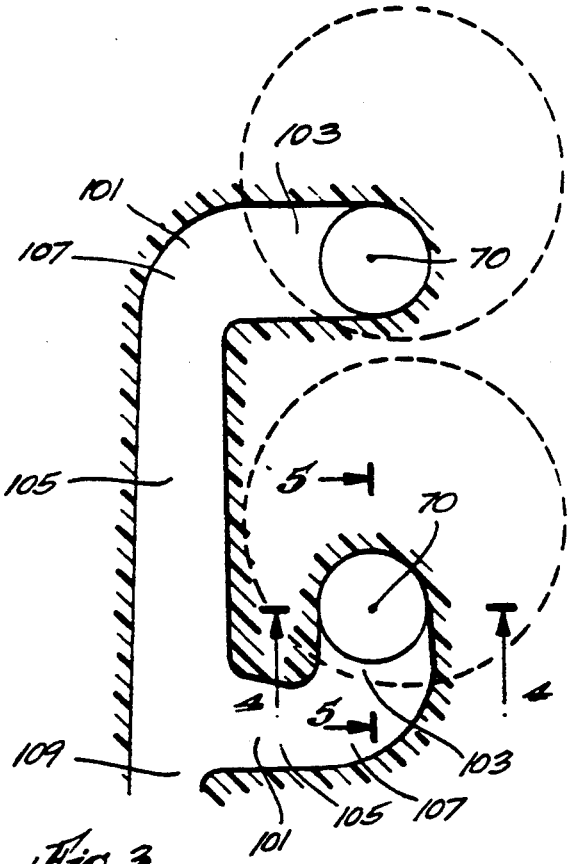
FIG. 3 is a fragmentary sectional view which is taken along line 3—3 of FIG. 2, and which is reversed in the left to right direction.
Figure 5:
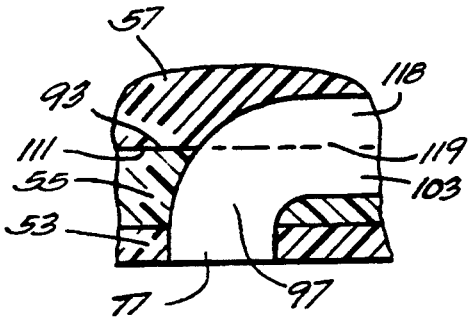
FIG. 5 is a fragmentary sectional view taken along line 5—5 of FIG. 3.
Figure 4:
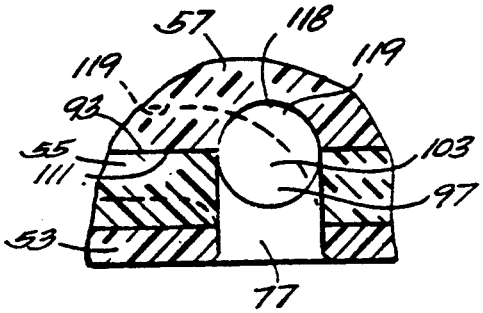
FIG. 4 is a fragmentary sectional view taken along line 4—4 of FIG. 3.

The construction shown in FIG. 2 is simultaneously representative of a single cylinder engine and of a two cylinder engine (as is shown in FIG. 3). The combustion chamber 69 (or chambers in the case of a two cylinder engine) can also be defined by one or more other surfaces, such as the surface 71 which extends between the inclined surface 65 and the cylinder block mating surface 61 and which can be of any suitable shape.

Still further in addition, the first pattern piece 53 includes an upper planar glue surface 75 which extends in parallel and spaced relation to the inclined surface 65 and on the side thereof opposite from the cylinder block mating surface 61 or from the associated cylinder. Preferably, as shown in FIG. 2, and contrary to the construction shown in FIG. 1, the glue surface 75 extends to the entire side exterior surface 76 of the first pattern piece 53. Also included in the first pattern piece 53 are inlet and outlet fluid flow passage portions 77 (one shown) which extend between the inclined surface 65 and the upper glue surface 75 and which are generally cylindrical and in concentric relation to the axis 70 of valve member movement perpendicular to the inclined surface 65.

The first pattern piece 53 can also include a first through recess 79 which extends between the cylinder block mating surface 61 and the upper glue surface 75, and a second blind recess 81 in the cylinder block mating surface 61, which recesses 79 and 81, in the resultant head casting, provide portions of coolant jackets communicating through the cylinder block mating surface 61 with coolant jackets in the cylinder block.

In addition, the first pattern piece 53 includes, in the glue surface 75, a recess 83 which provides, in the cylinder head casting, a portion of a cylinder head coolant jacket.

The second pattern piece 55 includes a first or lower planar glue surface 91 which is generally coextensive with, and is glued or otherwise suitably fixed to, the glue surface 75 of the first pattern piece 53, i.e., extends to the entire exterior side surface 92 of the second pattern piece 55.

The second pattern piece 55 also includes, in order to permit variation in the location of fluid flow passages 97 hereinafter described, and without changing the cross sectional flow areas thereof, and while maintaining a smooth flow configuration, a second or upper planar glue surface 93 which extends in spaced and parallel relation to the lower glue surface 91 and, preferably, to the entire exterior side surface 92 of the second pattern piece 55.

In addition, the second pattern piece 55 includes the just mentioned inlet and exhaust fluid flow passage portions 97 (one shown) which extend between the glue surfaces 91 and 93 and which, at the lower glue surface 91, register with the inlet and exhaust fluid flow passages 77 of the first pattern piece 53. As shown, at the second or upper glue surface 93, the fluid flow passage portions 97 merge with respective recesses 101 in the upper glue surface 93.

Each of the recesses 101 includes (as shown in FIG. 3) a first subportion 103 extending radially from the axis 70 of valve member movement in the second pattern piece 55 and a second subportion 105 extending generally at an angle (approximately 90° in the specifically illustrated construction) to the radially extending subportion 103 and connected thereto by an arcuate or elbow subportion 107. The second subportions 105 of the recesses 101 can, in the case of a two cylinder engine, be merged (as shown in FIG. 3) into a common recess portion 109 which extends to an exterior side surface portion (not shown) whereat a suitable inlet or exhaust manifold can be attached to facilitate fluid flow of incoming air (or air/fuel mixture) or outgoing exhaust gas from the combustion chambers.

Still further in addition, the second pattern piece 55 preferably includes a through recess 106 which extends between the glue surfaces 91 and 93 and which, in the glue surface 91, registers with the recess 79 in the upper glue surface 75 of the first pattern piece 53. In addition the second pattern piece 55 includes a through recess 108 extending between the upper and lower glue surfaces 91 and 93 and communicating with the recess 83 in the upper glue surface 75 of the first pattern piece 53.

The third pattern piece 57 includes a first or lower planar glue surface 111 which is generally coextensive with and is adhesively or otherwise suitably fixed to, the upper or second glue surface 93 of the second pattern piece 55, i.e., extends to the entire exterior side surface 115 of the third pattern piece 57. The third pattern piece 57 also includes a second or upper planar glue surface 113 which extends in parallel and spaced relation to the lower glue surface 111.

Still further in addition, the third pattern piece 57 includes, in the lower glue surface 111, recesses 117 which mate with the recesses 101 in the second or upper glue surface 93 of the second pattern piece 55 and which respectively include a first subportion 118 corresponding to the first subportions 103 of the recesses 101 and extending radially with respect to the axes 70 of valve member movement, and second subportions corresponding to the second subportions 105 of the recesses 101 and extending at about a 90° angle to the associated radially extending subportions 118 and to each other and respectively connected thereto by arcuate or elbow subportions corresponding to the elbow subportions of the recesses 101.

As with the recesses 101 in the upper glue surface 93 of the second pattern piece 55, the second subportions of the recesses 117 can be merged into a common recess portion which corresponds to the common recess portion 109 and which extends to a portion of the exterior side surface 115 and is adapted to have attached thereto a suitable inlet or exhaust manifold.

As a consequence, when the second and third pattern pieces 55 and 57 are adhesively glued together, the recesses 101 and 117 in the glue surfaces 93 and 111 combine to provide fluid flow passage portions 119 which extend to the before mentioned portions of the exterior side surfaces 92 and 115 and to the fluid flow passage portions 97 in the glue surfaces 93 of the second pattern piece 55.

The disposition of the glue surfaces 93 and 111 in parallel relation to the inclined valve surface 65 of the first pattern piece 53 and the radial disposition of the radially extending recess subportions 103 and 118 of the recesses 101 and 117 permits selectivity of the angle at which the radially extending recess subportions extend relative to the axes 70 of valve member movement, and of the angular relation of the radial or first subportions 103 and 118 to the second subportions and thus provide flexibility in design without compromising smooth fluid flow as a result of the absence of one or areas of reduced cross sectional flow.

In other words, while fluid flow through the passages 77 in the first pattern piece 53, is perpendicular to the glue surfaces 75, 91, 93 and 111, the arrangement in the second and third pattern pieces 55 and 57 permits turning of the fluid flow passages 77 to directions generally parallel to the inclined glue surfaces 93 and 113. The fluid flow passage portions 119 extending between the second and third pattern pieces 55 and 57 can be arranged to extend, as desired, to the exterior side surfaces 92 and 115, thereby offering substantial advantage in connection with location of the fuel/air supply and exhaust manifolds, and offering particular advantages in connection with two cylinder engines.

The third pattern piece 57 also includes a through recess 125 which extends between the glue surfaces 111 and 113, and which is in registry with the through recess 106 in the upper glue surface 93 of the second pattern piece 55, thereby providing for water jacketing in the cylinder head casting. In addition, the third pattern piece 57 includes a recess 127 which is located in the lower glue surface 111 and which registers with the recess 108 in the upper glue surface 93 of the second pattern piece 55. Still further, the third pattern piece 57 includes a recess 129 in the upper glue surface 113.

The fourth pattern piece 59 includes a lower or planar glue surface 141 which is adhesively or otherwise suitably fixed to the upper glue surface 113 of the third pattern piece 57. The fourth pattern piece 59 also includes recesses 143 and 145 in the glue surface 141 registering with the recesses 125 and 129 extending in the upper glue surface 113 of the third pattern piece 57. In effect, the fourth pattern piece 59 provides a coolant jacket cover.

The cylinder block mating surface 61 of the resulting cylinder head casting can be suitably machined to produce a smooth surface for engagement with the cylinder block. In addition, a suitable threaded hole (not shown) can be provided in the cylinder head casting to accommodate therein a spark plug communicating with the combustion chamber. Other machining operations as desired may also be performed.

It is particularly noted that the parallel glue surfaces are all perpendicular to the direction or axis 70 of valve movement relative to the valve seats 67.

Various of the features of the invention are set forth in the following claims.

I claim:

1. A multi-piece cylinder head lost foam pattern assembly comprising a first piece having a planar valve seat surface extending at an angle other than 90° degrees to the axis of the associated cylinder, a glue surface extending in spaced and parallel relation to the valve seat surface on the opposite side thereof from the associated cylinder, and a first fluid flow passage portion extending between the valve seat surface and the glue surface, a second piece having a first glue surface engaging said glue surface of said first piece, a second glue surface extending in spaced and parallel relation to said first glue surface of said second piece, a second fluid flow passage portion extending between said first and second glue surfaces of said second piece, and registering with said first fluid flow passage portion in said first piece, and a recess formed in said second glue surface and communicating with said second fluid flow passage portion, and a third piece having a first glue surface engaging said second glue surface of said second piece and including therein a recess mating with said recess in said second glue surface of said second piece and forming, with said recess in said second piece, a third fluid flow passage portion communicating with said second fluid flow passage portion.

2. A lost foam pattern assembly in accordance with claim 1 wherein said recesses in said second glue surface of said second piece and said first glue surface of said third piece each include a first subportion extending radially from the axis of valve member movement perpendicular to said valve surface and a second subportion extending in angular relation to and communicating with said first subportion.

3. A multi-piece cylinder head lost foam pattern assembly for casting of a cylinder head including first and second combustion chambers respectively associated with spaced and parallel first and second cylinders, said assembly comprising a first piece having first and second co-planar valve seat surfaces which are respectively associated with said first and second combustion chambers and which respectively extend at an angle other than 90° degrees to the axes of the associated cylinders, a glue surface extending in spaced and parallel relation to said valve seat surfaces on the opposite side thereof from the associated cylinders, and first and second fluid flow passage portions respectively extending generally perpendicularly to said valve seat surfaces and between said valve seat surfaces and said glue surface, a second piece having a first glue surface engaging said glue surface of said first piece, a second glue surface extending in spaced and parallel relation to said first glue surface of said second piece, third and fourth fluid flow passage portions extending between said first and second glue surfaces of said second piece and respectively registering with said first and second fluid flow passage portions in said first piece, and first and second recesses formed in said second glue surface and respectively communicating with said third and fourth fluid flow passage portions, and a third piece having a first glue surface engaging said second glue surface of said second piece and including therein third and fourth recesses respectively mating with said first and second recesses in said second glue surface of said second piece and respectively forming, with said first and second recesses in said second piece, fifth and sixth fluid flow passage portions respectively communicating with said third and fourth fluid flow passage portions.

4. A lost foam pattern assembly in accordance with claim 3 wherein said second glue surface of said second piece and said first glue surface of said third piece respectively include additional recesses forming a common fluid flow passage portion communicating with said fifth and sixth fluid flow passage portions.

5. A lost foam pattern assembly in accordance with claim 4 wherein said fifth and sixth fluid flow passage portions respectively include first subportions respectively extending radially from the axes of valve member movement perpendicular to said valve surfaces, said first subportion of said fifth and sixth fluid flow passage portions extending in angular relation to each other, said fifth and sixth fluid flow passage portions also respectively including second subportions respectively extending in angular relation to and communicating with said first subportions, said second subportions merging to form said common fluid flow passage portion.

6. A lost foam pattern assembly in accordance with claim 5 wherein said first subportions extend at 90° angular relation to each other and wherein said second subportions extend in 90° angular relation to said first subportions.

* * * * *